US005992026A

United States Patent [19]

Hlava

[11] Patent Number: 5,992,026

[45] Date of Patent: Nov. 30, 1999

[54] KITCHEN APPLIANCE WITH PIVOTAL MOUNTING

[75] Inventor: Lorens G. Hlava, Clinton, Mo.

[73] Assignee: The Rival Company, Kansas City, Mo.

[21] Appl. No.: 09/005,261

[22] Filed: Jan. 9, 1998

[51] Int. Cl.[6] ..... B67B 7/46

[52] U.S. Cl. ..... 30/410; 30/434; 30/296.1; 31/323

[58] Field of Search ..... 30/410, 416, 434, 30/296.1; 248/288.11, 291.1, 292.13; 312/322, 323

[56] References Cited

U.S. PATENT DOCUMENTS

| | | |
|---|---|---|
| D. 202,268 | 9/1965 | Reed . |
| D. 219,200 | 11/1970 | McCue . |
| D. 229,603 | 12/1973 | Eckle . |
| D. 230,005 | 1/1974 | Weiss . |
| D. 240,700 | 7/1976 | Scott . |
| D. 276,406 | 11/1984 | Johnson et al. . |
| D. 291,173 | 8/1987 | Stowell et al. . |
| D. 306,548 | 3/1990 | Mezey . |
| D. 366,404 | 1/1996 | Indindoli . |
| D. 366,997 | 2/1996 | Carbone . |
| 2,204,368 | 6/1940 | Kublin . |
| 2,579,189 | 12/1951 | Jensen . |
| 2,651,838 | 9/1953 | Curtis . |
| 2,662,279 | 12/1953 | Wilson . |
| 2,679,098 | 5/1954 | Deicken . |
| 2,738,943 | 5/1956 | Lawrence . |
| 2,765,207 | 10/1956 | Moore . |
| 2,771,263 | 11/1956 | Boho . |
| 2,896,319 | 7/1959 | Pinette . |
| 2,925,237 | 2/1960 | Fox . |
| 2,979,815 | 4/1961 | Rhode et al. . |
| 2,997,785 | 8/1961 | Pinette . |
| 3,079,683 | 3/1963 | Carew et al. . |
| 3,105,297 | 10/1963 | Clowers . |
| 3,156,044 | 11/1964 | Congdon et al. . |
| 3,176,063 | 3/1965 | Jepson et al. . |
| 3,216,108 | 11/1965 | Jepson et al. . |
| 3,254,406 | 6/1966 | Hubrich . |
| 3,307,255 | 3/1967 | Hubrich . |
| 3,313,023 | 4/1967 | Jepson et al. . |
| 3,348,305 | 10/1967 | Bielak et al. . |
| 3,360,853 | 1/1968 | Chambers et al. . |
| 3,376,671 | 4/1968 | Wolter . |

(List continued on next page.)

FOREIGN PATENT DOCUMENTS

| | | |
|---|---|---|
| 1396874 | 3/1965 | France . |
| 30 48 063 | 7/1982 | Germany . |
| 154429 | 12/1920 | United Kingdom . |

OTHER PUBLICATIONS

Cornwell Corporation, "The Three Minute Egg," Jun. 21, 1973, Home Furnishings Daily, p. 13.

Cornwell Corporation, "The Three Minute Egg," Jan. 8, 1974, Home Furnishings Daily, p. 19.

Wellman Industrial Co., Ltd., "Combination Knife & Scissors Deluxe Can Opener," Dec. 1980, Hong Kong Enterprise, p. 35.

Fatia Industrial Co., Ltd., "The Best Products of . . . " Nov. 1988, Hong Kong Enterprise, p. 230.

*Primary Examiner*—Hwei-Siu Payer

*Attorney, Agent, or Firm*—Brinks Hofer Gilson & Lione; Francis E. Marino

[57] ABSTRACT

A pivotally mounted kitchen appliance including a mounting bracket for mounting flush with a flat surface, the bracket defining a recessed area and at least two mounting members that extend therefrom, a housing including a can opener and having an upper portion pivotally mounted between the mounting members for pivotal movement between a lowered position wherein the housing extends substantially perpendicular to the flat mounting surface and a raised position wherein the housing extends substantially parallel to the flat mounting surface and is partially concealed within the recessed area, and at least one keyed pivot pin on either the housing or the mounting members for releasably retaining the housing in the lowered and raised positions.

21 Claims, 5 Drawing Sheets

U.S. PATENT DOCUMENTS

| | | | |
|---|---|---|---|
| 3,433,444 | 3/1969 | Smith . | |
| 3,477,263 | 11/1969 | Jepson et al. . | |
| 3,520,056 | 7/1970 | Scott . | |
| 3,585,717 | 6/1971 | Bielak et al. . | |
| 3,673,682 | 7/1972 | Yamamoto . | |
| 3,675,321 | 7/1972 | Arel et al. . | |
| 3,689,997 | 9/1972 | McLean . | |
| 3,706,135 | 12/1972 | Fukunaga et al. . | |
| 3,763,748 | 10/1973 | Gallagher, Jr. . | |
| 3,765,085 | 10/1973 | Ponczek et al. . | |
| 3,805,380 | 4/1974 | Yamamoto . | |
| 3,814,366 | 6/1974 | Staifer | 312/323 |
| 3,818,589 | 6/1974 | Oberto . | |
| 3,845,928 | 11/1974 | Barrett et al. . | |
| 3,858,313 | 1/1975 | Yamaguchi . | |
| 3,881,247 | 5/1975 | Niwa . | |
| 3,911,571 | 10/1975 | Ponczek et al. . | |
| 3,942,247 | 3/1976 | Ponczek et al. . | |
| 3,949,468 | 4/1976 | McLean et al. . | |
| 3,955,276 | 5/1976 | Pauty . | |
| 3,982,455 | 9/1976 | Bowman . | |
| 4,028,805 | 6/1977 | Figlia . | |
| 4,053,981 | 10/1977 | Aberer . | |
| 4,086,835 | 5/1978 | Frederick . | |
| 4,196,821 | 4/1980 | Teti, Jr. et al. . | |
| 4,207,676 | 6/1980 | Okumura . | |
| 4,389,780 | 6/1983 | Ostroski et al. . | |
| 4,466,664 | 8/1984 | Kondou . | |
| 4,520,567 | 6/1985 | Crawford | 30/424 |
| 4,534,108 | 8/1985 | Yamamoto et al. . | |
| 4,561,182 | 12/1985 | Yamamoto et al. . | |
| 4,620,476 | 11/1986 | Brym . | |
| 4,635,615 | 1/1987 | Itoh et al. . | |
| 4,663,849 | 5/1987 | Nickelson . | |
| 4,702,007 | 10/1987 | Nomura et al. . | |
| 4,733,472 | 3/1988 | Belcourt . | |
| 4,734,985 | 4/1988 | Ozaki | 30/404 |
| 4,831,735 | 5/1989 | Bast et al. . | |
| 4,860,455 | 8/1989 | Conneally . | |
| 4,922,617 | 5/1990 | Kurz . | |
| 4,949,928 | 8/1990 | Hoshino . | |
| 4,979,308 | 12/1990 | Moore . | |
| 4,995,164 | 2/1991 | Borger et al. . | |
| 5,211,368 | 5/1993 | Kitamura . | |
| 5,219,240 | 6/1993 | Kitamura . | |
| 5,313,708 | 5/1994 | Edwards et al. . | |
| 5,383,637 | 1/1995 | Biber . | |
| 5,421,092 | 6/1995 | Guilmette et al. . | |
| 5,478,998 | 12/1995 | Charych et al. . | |
| 5,492,296 | 2/1996 | Biber . | |
| 5,503,491 | 4/1996 | Lu . | |
| 5,666,735 | 9/1997 | Kosten et al. | 30/410 |

KITCHEN APPLIANCE WITH PIVOTAL MOUNTING

BACKGROUND OF THE INVENTION

The invention relates generally to kitchen applications and more specifically to a kitchen appliance which is adapted to be mounted pivotally to a kitchen cabinet.

Most portable kitchen appliances, such as automatic motorized can openers, require a fairly heavy and enlarged base to provide stability and safety for the user. Unfortunately, even the smallest of these electric appliances tends to be inconvenient because they occupy counter space in the kitchen. To save limited counter space and to alleviate some of the inconvenience involved in storing and retrieving various appliances, manufacturers have attempted to mount such appliances on walls or to cabinets. Various appliances such as coffee makers, can openers, toaster ovens and knife sharpeners have been modified for such mounting. Various prior art patents show some of these configurations.

For example, U.S. Pat. No. 5,421,092 discloses a pivotably mounted can opener which utilizes a U-shaped bracket. The can opener can be positioned to show a decorative face or an operating face. The disclosed can opener uses cantilevered detents to lock the can opener in various positions. U.S. Pat. No. 4,663,849 also discloses a pivotally mounted can opener. This patent discloses a box-shaped housing pivotably secured to a mounting means for mounting to the underside of a kitchen cabinet. The housing is pivotable along a plane running parallel to the underside of the cabinet. Another patent is U.S. Pat. No. 4,620,476, which discloses a multi-purpose kitchen appliance which is, mountable to a removable, rigid bracket. The bracket can mount various interchangeable appliances.

The various shortcomings of these previous units also include a lack of compactness and hideability, a displeasing appearance, and overly complex mounting hardware.

It is, therefore, an object of the present invention to provide an improved kitchen appliance which can be mounted to the underside of a cabinet in a relatively simple manner.

It is another object of the present invention to provide a cabinetmounted kitchen appliance which pivots to effectively conceal or enclose a portion of the appliance.

It is still another object of the present invention to provide a mountable kitchen appliance which exhibits improved stability in both the raised and lowered positions.

Other objects and advantages of the present invention will become apparent during the following detailed description, taken in conjunction with the accompanying drawings.

SUMMARY OF THE INVENTION

According to a first aspect of the present invention, a pivotally mounted kitchen appliance is provided including a mounting bracket for mounting flush with a flat surface, the bracket defining a recessed area and at least two mounting members that extend therefrom. A housing is also provided including a can opener and having an upper portion pivotally mounted between the mounting members for pivotal movement between a lowered position wherein the housing extends substantially perpendicular to the flat mounting surface and a raised position wherein the housing extends substantially parallel to the flat mounting surface and is partially concealed within the recessed area. Means on either the housing or the mounting members are provided for releasably retaining the housing in the lowered and raised positions.

According to another aspect of the present invention, a kitchen appliance includes a mounting bracket having at least two mounting members extending therefrom, at least one of the members defining a key recess, a housing mounted between the members for pivotal movement between a lowered and a raised position, an upper interior portion of the housing defining a first ridge and a second ridge, a lower interior portion of the housing containing a working unit, at least one pivot pin extending through one of the members and through the ridges, the pivot pin being axially movable within the housing and defining a flange and a keyed end portion, means on the pivot pin and the housing to prevent rotation of the pin relative to the housing, and a coil spring compressible between the flange and the second ridge to bias the keyed end portion to extend through a recess in the second ridge, the keyed end portion receivable into the key recess of the mounting bracket.

In another aspect of the present invention, at least one key recess is provided having a first key recess portion and a second key recess portion, the second key recess portion being positioned at an angle to the first key recess portion. The keyed end portion is closely receivable into the first key recess portion or the second key recess portion upon pivoting of the housing relative to the mounting bracket.

In yet another aspect of the present invention, the pivot pin defines a keyed end portion and a pin extension portion extending from the end portion. A biasing member is mounted within the housing to bias the keyed end portion of the pin toward the mounting member so that the keyed end portion extends into the keyed opening of the mounting member. The keyed opening is adapted to closely receive the keyed end portion to prevent rotation of the keyed end portion within the opening and to loosely receive the pin extension portion. A presser cap is mounted adjacent the mounting member. The cap defines a projecting member adapted to depress the pin extension portion toward the housing upon depression of the cap, thereby releasing the keyed end portion from one of the keyed opening to allow the housing to rotate relative to the mounting bracket.

In yet another aspect of the present invention, a kitchen appliance is provided which includes a mounting bracket having at least two mounting members extending therefrom. At least one of the mounting members defines at least one key recess about a first axis extending through the mounting members. A housing is mounted between the mounting members for pivotal movement about the first axis, and an upper interior portion of the housing defines a first ridge and a second ridge. At least one pivot pin extends through one of the mounting members along the first axis and through the first and second ridge. The pivot pin axially movable within the housing and defines a flange and a keyed end portion, the keyed end portion being receivable into the key recess of the mounting member. Means on the pivot pin and the housing are provided to prevent rotation of the pin relative to the housing, and a coil spring is provided, compressible between the flange and the second ridge of the housing, to bias the flange against the first ridge, thereby biasing the keyed end portion to extend through a recess in the second ridge.

Thus, the present invention allows the user to conveniently mount a kitchen appliance, such as a can opener, to the underside of a cabinet or table without giving up valuable above-counter space. The retractable appliance also provides a pleasing appearance by retracting to hide most components from view. Furthermore, the configuration of the present invention facilitates installation, maintenance and cleaning of the appliance, while providing improved mounting stability over prior art appliances.

It is to be understood that both the foregoing general description and the following detailed description are exemplary and explanatory and are intended to provide further explanation of the invention as claimed. The invention, together with further objects and attendant advantages, will best be understood by reference to the following detailed description, taken in conjunction with the accompanying drawings.

DETAILED DESCRIPTION OF THE PREFERRED EMBODIMENT

Figure 1:
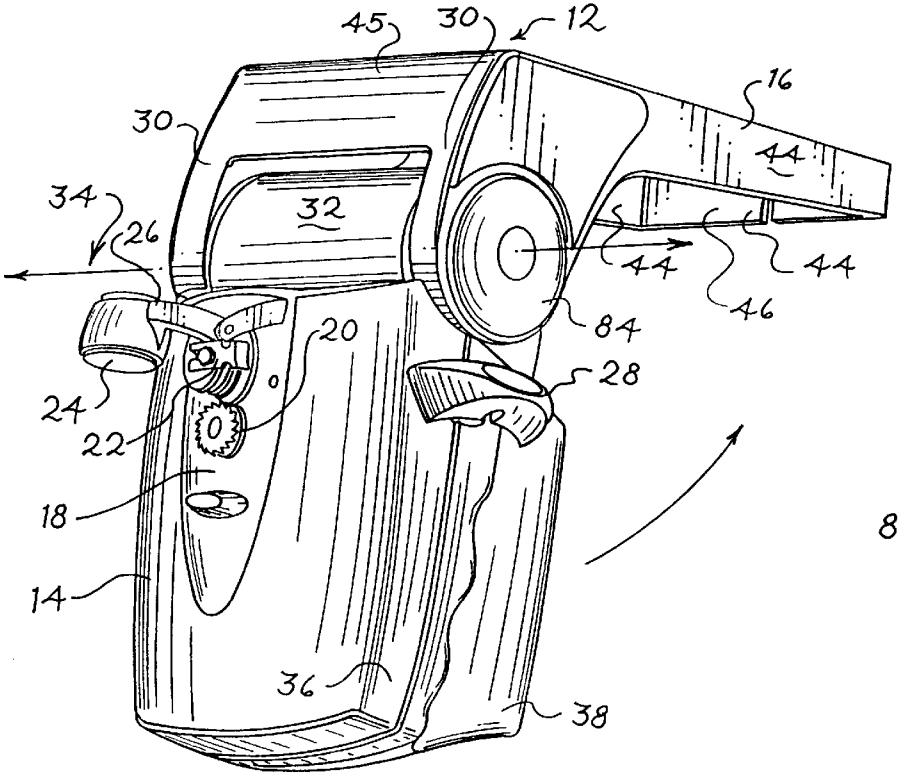
FIG. 1 is a perspective view of a kitchen appliance which incorporates a presently preferred embodiment of the present invention in a lowered position.

Referring now to the drawings, FIG. 1, shows a cabinet-mountable kitchen appliance 12 of the preferred embodiment of the present invention. The appliance 12 includes a housing 14 mounted to mounting brackets 16. In the preferred embodiment, the housing 14 contains a conventional electric can opener having an outwardly facing operating face 18. Typical of can openers of this type, there are mounted within the housing 14 a shaded pull motor (not shown) which drives a traction wheel 20 to engage a can against the cutter blade 22. A magnet 24 is mounted on a lever arm 26 projecting from the face 18 to retain a severed lid from the opened can. The operation of the can opener is controlled via operating lever 28 which projects from the side of the housing 14.

In the preferred embodiment, the can opener utilized within the housing 14 comprises a unit of the type described in U.S. Pat. No. 5,313,708 which is owned by The Rival Company. This patented disclosure is hereby incorporated by reference into the present application. Furthermore, those skilled in the art would appreciate that various other types of appliances or can openers may be utilized within or as part of housing 14 in the present invention.

Figure 2:
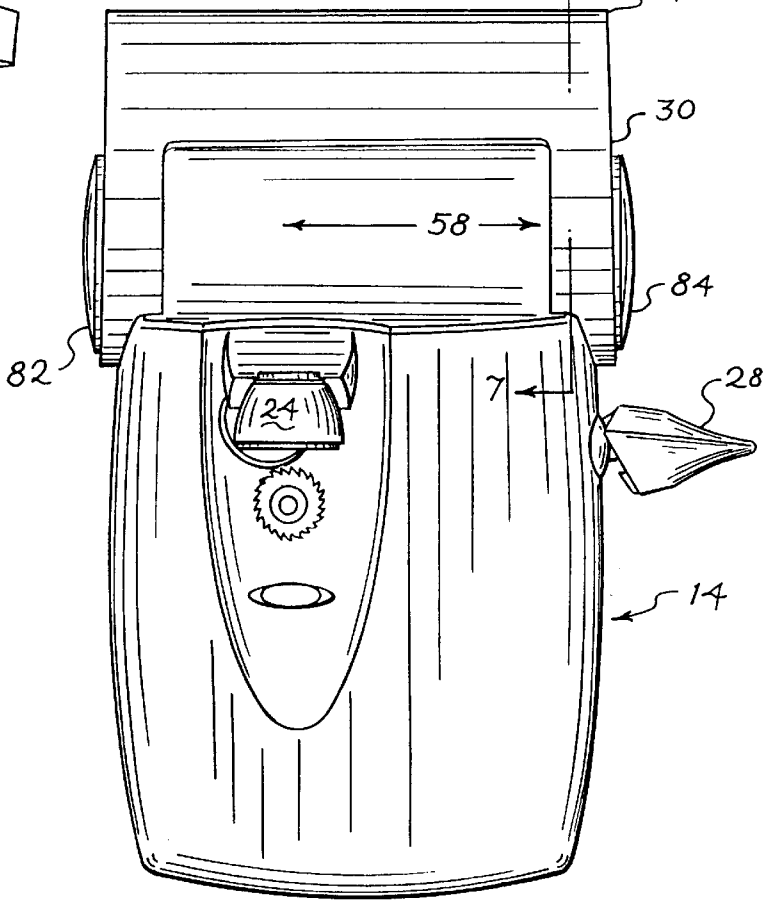
FIG. 2 is a front view of the appliance of FIG. 1.

As can be seen in FIGS. 1 and 2, the mounting bracket 16 includes a pair of descending mounting members 30 which capture the upper portion 32 of the housing 14 between them. As will be described in more detail below, the mounting members 30 allow the upper portion 32 to be mounted between them along a common axis 34. The housing 14 thus can pivot around axis 34 to a raised or lowered position.

Figures 3, 8A, 8B:
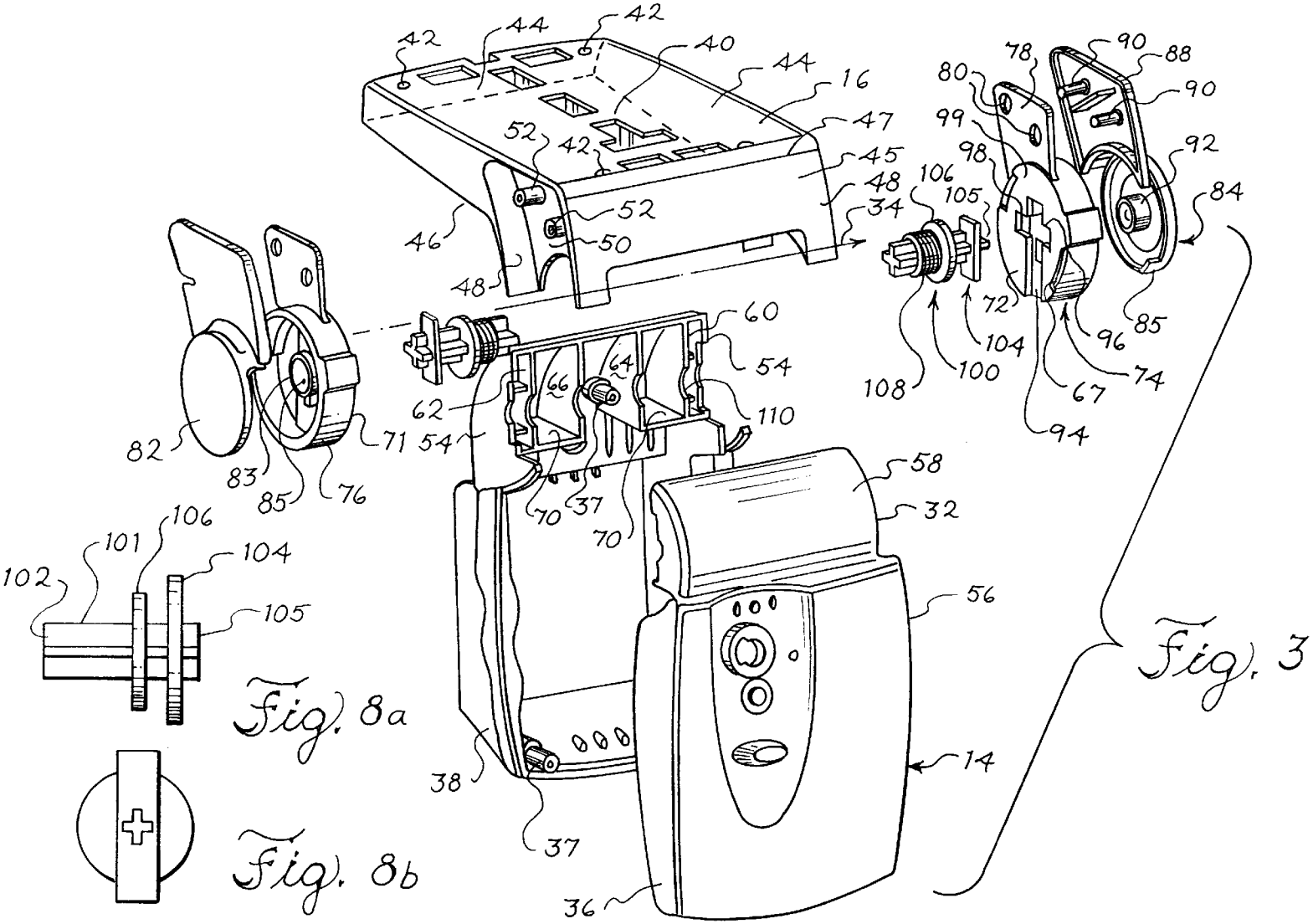
FIG. 3 is an exploded perspective view of the appliance of FIG. 1 with some parts removed for clarity.
FIGS. 8*a* and 8*b* show a side and front view of a pivot pin utilized in the present invention of FIG. 1.

FIG. 3 is an exploded diagram showing the parts used to pivotally mount the housing 14 to the bracket 16.

As shown in FIG. 3 in combination with the previous figures, the mounting bracket 16 preferably includes a flat, planar portion 40 for mounting to the underside of a cabinet via fastener openings 42. Other known fastening means and mounting brackets of other shapes may be utilized. Sidewalls 44 and front wall 45 project generally perpendicularly from the planar portion 40 to define an interior space 46. The front wall 45 preferably includes front bracket edge 47. Preferably, two parallel sidewalls 44 and the front wall 45 define recesses 48 which descend downwardly from the planar portion 40. The recesses 48 include an interior wall 50 from which project a pair of cylindrical mountings 52.

The housing 14 is made up of front housing 36 and rear housing 38. The front and rear housings 36 and 38 are fastened together using screws received in conventional mountings 37. As one skilled in the art can appreciate, the lower portion 56 of the housing may be of any generalized shape, and conventional can opener mechanisms, such as the motor, linkages and gearing (not shown) may be contained within the housing and sized to fit appropriately. The cutter and traction mechanisms can also preferably project from the front face 18 of the front housing 36.

The upper portion 32 of the housing 14 is preferably defined by a generally cylindrical surface 58 which is axially centered along axis 34, which is parallel to front edge 47. The interior of the upper housing portion 32 is preferably further defined by support walls 54. The interior area of the upper housing portion 32 preferably defines a plurality of bulkhead-like ridges 60–66 extending perpendicularly to the axial cylindrical surface 58 between the front and rear housings 36 and 38 and preferably parallel to the support walls 54. Preferably, a pair of shelves 70 extend between the front and rear housings 36 and 38 adjacent to the ridges to add support thereto. While FIG. 3 only shows half-portions of these interior features on the rear housing portion 38, similar half-features are present within front housing portion 36. When the two halves 36 and 38 are mounted together, the features described herein are defined, as one skilled in the art would appreciate. First ridges 60 and 62 are located nearest to the support walls 54, and second ridges 64 and 66 are located toward the center of the housing 14. Each of the ridges 60, 62, 64 and 66 defines a circular opening 60*a*, 62*a*, 64*a* and 66*a*, respectively. Each of the openings 60*a*, 62*a*, 64*a*, and 66*a* of the upper housing portion 32 are concentric along axis 34 when mounted to the bracket 16. Each of the support walls 54 define a keyed opening aligned with the openings 60*a*, 62*a*, 64*a* and 66*a* and sized to receive a pivot pin 100 as described in detail below.

To mount the housing 14 pivotally to the mounting bracket 16, a pair of cylindrical hubs 74 and 76 are provided as separable portions of mounting members 30 for mounting over the support walls 54 of the upper housing portion 32. Each hub includes an interior side 71 and 72, respectively. The hubs are held in place by ears 74*a* and 76*a*, respectively, which include openings 80 defined therein. The openings 80 are aligned with and inserted over the cylindrical mountings 52 of the mounting bracket recesses 48, and the ears 74*a* and 76*a* are sized and shaped to fit into the recesses 48 as shown. A generally circular presser cap 84 and a generally circular endcap 82 are used to conceal the interiors of the hubs 74 and 76. The presser cap 84 includes a pair of cantilevered pegs 85 which project from the cap 84. Likewise, the endcap 82 includes a pair of cantilevered pegs 83. The pegs 83 and 85 are received within a pair of annularly spaced slots 67 within each of the hubs 74 and 76. The slots retain the pegs 83 in place over the open ends of the hubs 74 and 76. The cover ears 88 and 86 include projecting pegs 90 which are inserted through openings 80 and received into the hollow portions of cylindrical mountings 52. The presser cap 84 is thereby positioned over the hub 74. Presser cap 84 includes a centered, cylindrical pressing member 92 which projects inwardly toward the hub 74. The presser cap 84 is preferably flexibly mounted to the cover ear 88.

The interior side 71 of the hub 76 defines a circular opening 95 through the hub. The interior side 72 of hub 74 defines a circular keyed opening 96 which, when properly positioned with the housing 14 and the mounting bracket 16, is centered around the axis 34. The openings 95 and 96 are reinforced annularly by molded collars 93. The keyed opening 96 on the interior side 72 is surrounded by a pair of juxtaposed key recesses 98 and 99. In particular, key recess 98 is elongated and generally rectangular in shape, and key recess 99 is also generally rectangular in shape but positioned at an angle of 90 degrees to the key recess 98 within the plane of the interior side 72. The key recess 99 extends downwardly and merges with a groove 94 through the bottom edge of the interior side 72 of the hub 74. While the keyed opening 96 extends through the hub 74, the key recesses 99 and groove 94 are preferably defined to open only from the interior side 72. Preferably, the thickness of the walls of the hubs 74 and 76 is approximately 2.5 mm to ensure strength and wearability of the hubs and grooves.

The upper portion of the housing 14 is pivotally mounted to the hubs 74 and 76 and the mounting bracket 16 via a pair of pivot pins 100, as shown in FIGS. 3, 7*a*, 7*b*, 8*a* and 8*b* of the drawings. Each pivot pin 100 preferably comprises an elongated shaft member 101 having four grooves 102 axially defined within it to provide a keyed cross-shaped cross section. A generally rectangular keyed end port on 104 extends transversely near an end of the pin 100, and a pin extension portion 105 having a similar cross-section to the shaft member 101 extends axially beyond the keyed end portion 104. Near the central portion of the shaft 101, a flange 106 extends transversely to the shaft. The flange 106 is preferably circular.

Figure 6:
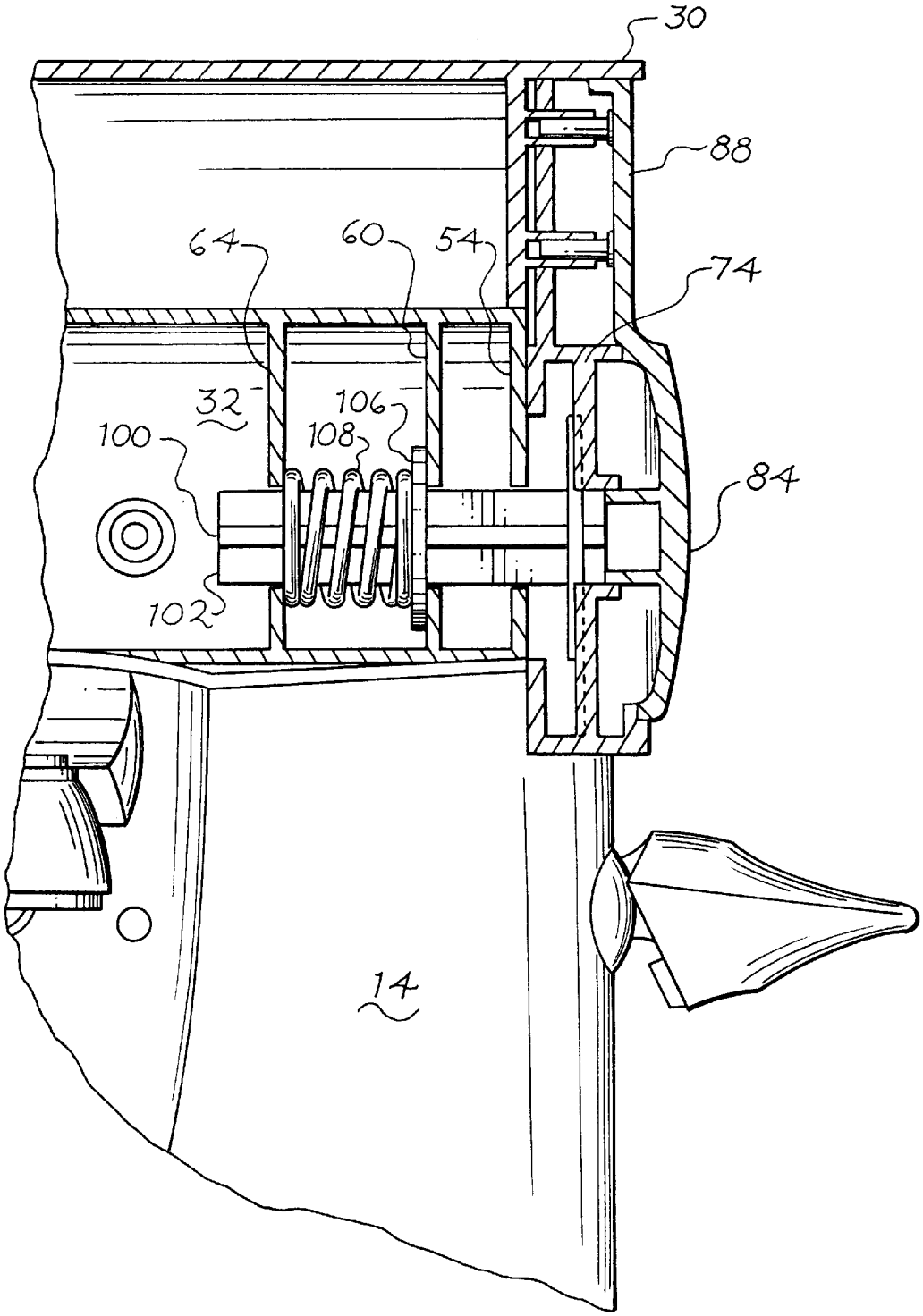
FIG. 6 is a partial cross-sectional view taken along line 6—6 of FIG. 4.

The pivot pins 100 are mounted within the upper housing poriton 32 as follows. For the left side of the housing portion 32 as shown in FIG. 6, a conventional coil spring 1083 is placed over the shaft 101 to abut the flange 106. The pin 100 is mounted through the openings 60*a* and 64*a* in the ridges 60 and 64 so that the spring 108 is compressed between the second ridge 64 and the flange 106. The flange 106 is thereby biased against ridge 60 so that the keyed end portion 104 and the extension portion 105 extend from ridge 60 and the support wall 54. A similar configuration is present on the right side of the appliance 12, with the pin 100 being mounted through openings 62*a* and 66*a* in ridges 62 and 66.

Preferably, openings 60*a* and 64*a* on the left side of the appliance 12 are keyed by a means 110 to prevent the pin 100 from rotating within the housing 32. Such means 110 can include a flange engaging one of the grooves 94 in the shaft member 101. Or by configuring the openings 60*a* and 64*a* to be of a cross-shaped cross-section to closely fit the cross-section of the shaft member 101. The keyed end portion 104 is sized to fit within the key recesses 99 and 98 of the hub 74.

Figure 5:
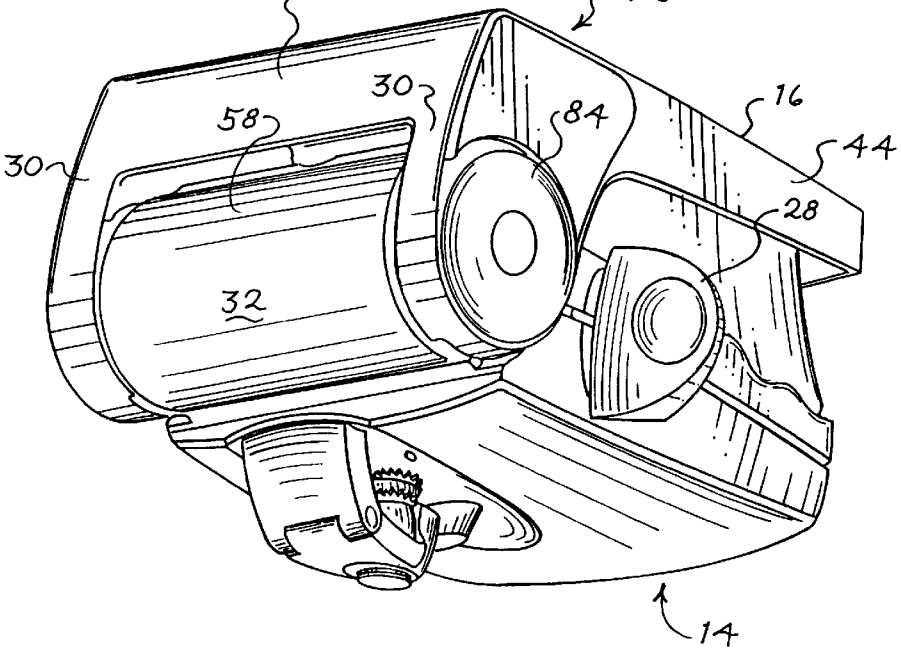
FIG. 5 is a perspective view of the appliance of FIG. 1 in a raised position.
Figure 4:
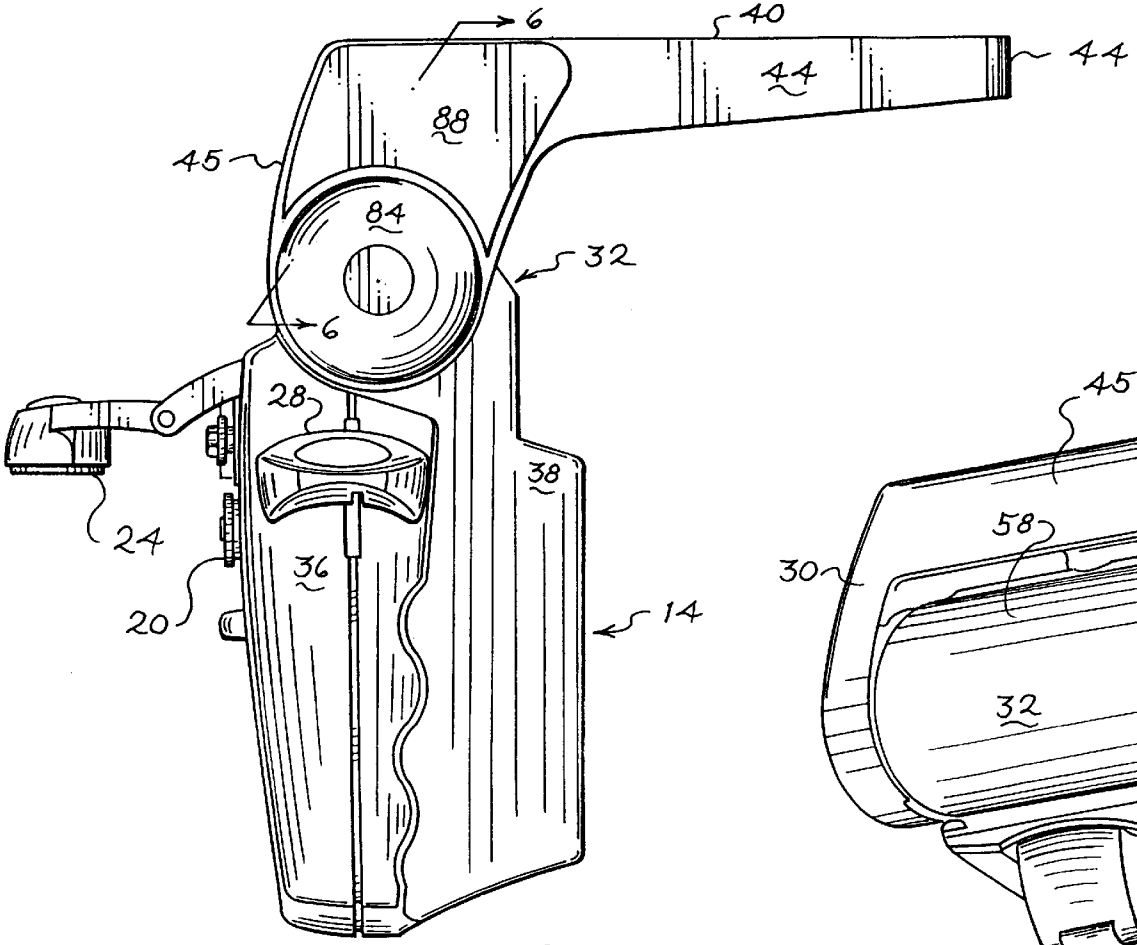
FIG. 4 is a side view of the appliance of FIG. 1.
Figure 7A:
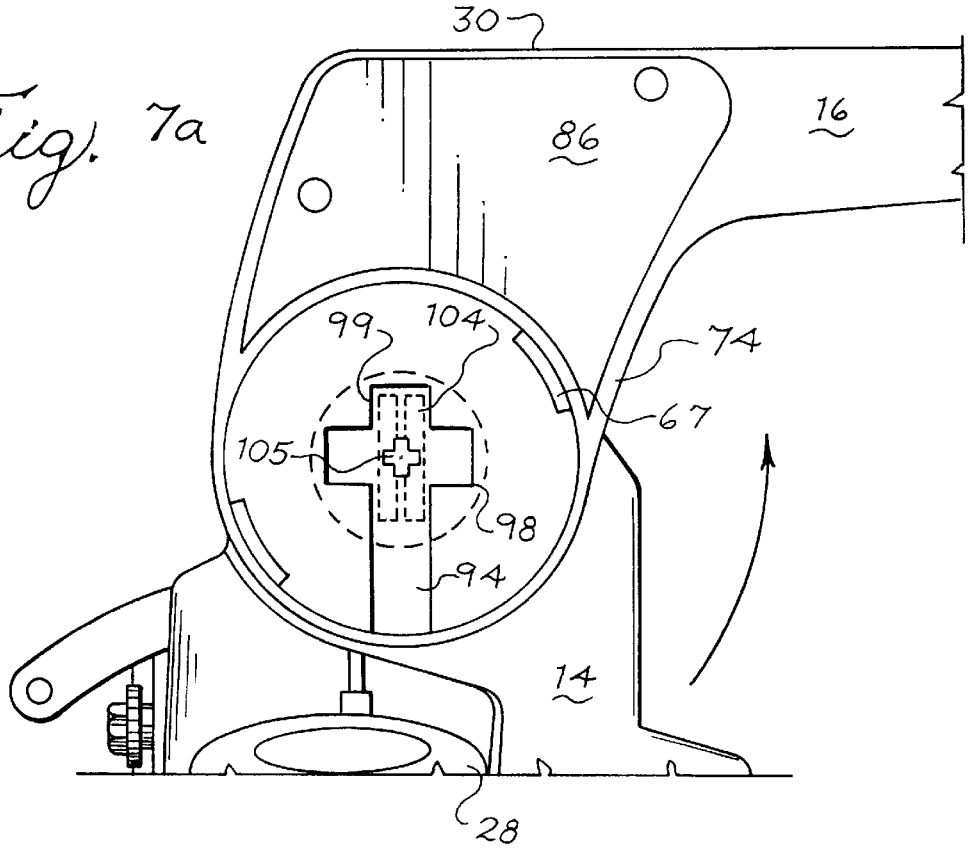
FIG. 7*a* is a partial cross-sectional view taken along the line 7—7 of FIG. 2, illustrating the appliance in a lowered position.
Figure 7B:
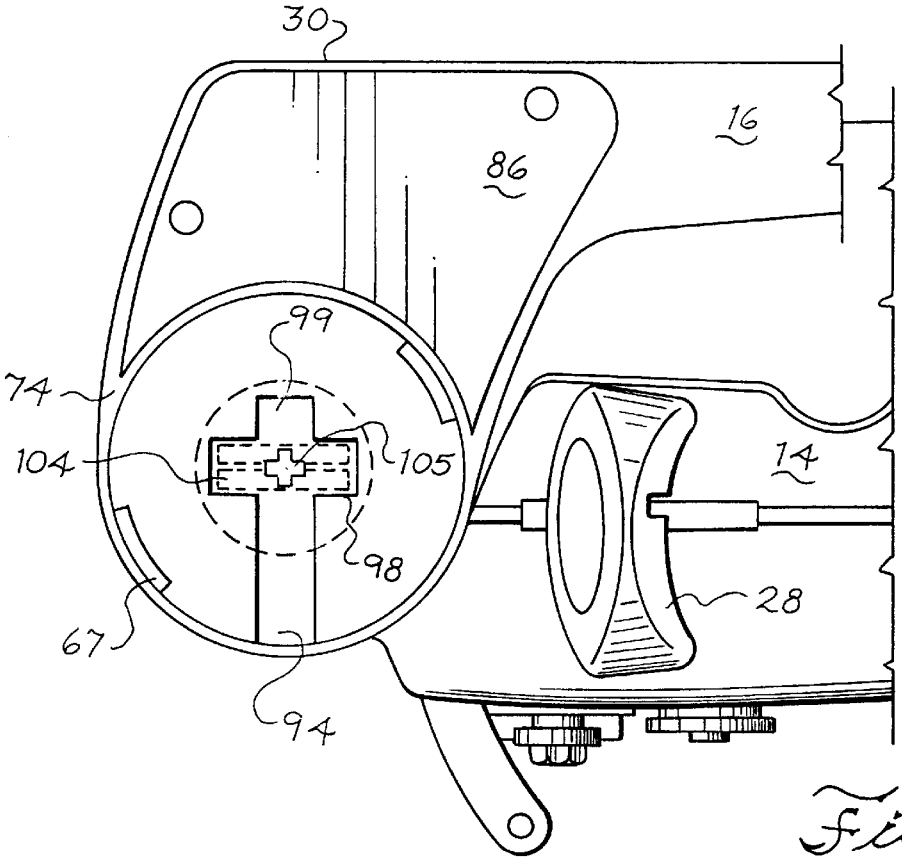
FIG. 7*b* is a partial cross-sectional view similar to FIG. 7*a*, illustrating the appliance in a raised position.

The key pin extension portions 105 for each pin 100 extends through the keyed opening 96 on each of the mounting hubs 74 and 76. thereby maintaining the housing 14 in a pivoting mounting. As shown in FIGS. 7*a* and 7*b*, the housing 14 is free to pivot about the pins 100 except for the keyed portion of the left side pin 100 which is received within the keyed recess 99 of the hub 74. To move the housing 14 from the lowered or extended position of FIG. 7*a* and FIG. 4, the user pushes the pressing member 92 onto the extension portion 105 by depressing the presser cap 84, thereby causing the pin 100 and the keyed end portion 104 to retract inwardly from the keyed recess 99 of the hub 74. The user can then rotate the housing 14 rearwards into the raised position shown in FIGS. 5 and 7*b*, thereby partially concealing the appliance housing 14 within the recessed interior space 46. Because the left pin 100 rotates with the housing, the keyed end portion 104 realigns with the angled keyed recess 98. When the user releases the presser cap 84, the spring 108 biases the pin 100 back towards the hub and the keyed end portion 104 toward the keyed recess 98. The recess 98 holds the keyed end portion 104 in this position and prevents rotation of the left pin 100, and thereby prevents rotation of the housing 14 back to the lowered position unless the user releases the keyed end portion 104 again via the presser cap 84. The inside of the presser cap 84 is configured to depress more fully if the slots and the pegs are properly aligned together.

It should be noted that, in the preferred embodiment, the right side of the appliance 12 does not utilize a keyed pin 100, presser cap, nor a means similar to means 110 for preventing rotation of the pin 100 within the housing 14. In the preferred embodiment, it has been found sufficient to key only one side, although one skilled in the art would realize that both sides may be keyed.

During installation of the housing 14 to the mounting bracket 16, the user may simply depress both pivot pins 100 and slide the unit between the hubs 74 and 76 through the grooves 94. The pins will snap back in place once the keyed opening 96 or opening 95 are reached.

The exterior portions of the appliance 12, including the housing 14, presser cap 84, endcap 82 and the hubs 74 and 76 are preferably molded from conventional ABS plastic. The pivot pins 100 are preferably molded from ACETAL plastic. These materials have been found to impart sufficient strength and stability to these components, although one skilled in the art would appreciate that other materials may be utilized.

Of course, it should be understood that a wide range of changes and modifications can be made to the preferred embodiment described above. It is therefore intended that the foregoing detailed description be regarded as illustrative rather than limiting and that it be understood that it is the following claims, including all equivalents, which are intended to define the scope of this invention.

I claim:

1. A kitchen appliance comprising:

a mounting bracket mountable flush with a flat surface, said bracket including at least two mounting members extending therefrom, at least one of said mounting members including a keyed recess;

a housing including a can opener, an upper portion of said housing being mounted between said mounting members for pivotal movement along an axis defined through said mounting members and said housing, said housing pivotally movable between a lowered position wherein said housing extends substantially perpendicular to said flat surface, and a raised position wherein said housing extends substantially parallel to said flat surface and is partially concealed within said mounting bracket; and at least one retractable pin extending from said housing substantially along said axis and including at least one keyed portion engageable with said keyed recess;

said pin, said keyed portion and said keyed recess cooperating to prevent rotation of said housings when said housing is in said raised position.

2. The appliance of claim 1 wherein said mounting members define a recessed area between said mounting members, and said housing is held within said recessed area.

3. The appliance of claim 2 wherein said keyed portion of said retractable pin is biased toward said keyed recess.

4. The appliance of claim 3 wherein said keyed portion of said retractable pin is biased by a coil spring, said pin extending through said coil spring.

5. The appliance of claim 4 wherein said keyed portion of said retractable pin may be biased away from said keyed recess by depressing said pin away from said keyed recess.

6. A kitchen appliance comprising:

a mounting bracket having at least two mounting members extending therefrom, at least one of said mounting members defining at least one key recess;

a housing mounted between said mounting members for pivotal movement between a lowered position and a raised position, an upper interior portion of said housing defining a first ridge and a second ridge, a lower interior portion of said housing containing a working unit;

at least one pivot pin extending through one of said mounting members and through said first ridge and said second ridge, said pivot pin axially movable within said housing and defining a flange and a keyed end portion;

means on said pivot pin and said housing to prevent rotation of said pin relative to said housing; and a coil spring compressible between said flange and said second ridge of said housing, said spring biasing said flange against said first ridge to bias said keyed end portion to extend through a recess in said second ridge, said keyed end portion receivable into said key recess of said mounting bracket.

7. The appliance of claim 6 wherein said means on said pivot pin includes a cross-shaped cross-section of said pivot pin for engagement with a cross-shaped opening in said housing.

8. The appliance of claim 6 wherein said means on said pivot pin includes a flange on said pin engageable with said housing.

9. The appliance of claim 6 wherein said keyed end portion includes a pair of rectangular flanges extending transversely to said pivot pin for complementary engagement with said key recess of said mounting bracket.

10. The appliance of claim 9 wherein said working unit further comprises an electric can opener.

11. A kitchen appliance comprising:

a mounting bracket having at least two mounting members extending therefrom, at least one of said mounting members defining at least one key recess having a first key recess portion and a second key recess portion, said second key recess portion positioned at an angle to said first key recess portion;

a housing mounted between said mounting members for pivotal movement between a lowered position and a raised position, an upper interior portion of said housing defining a first ridge and a second ridge, a lower interior portion of said housing containing a working unit;

at least one pivot pin axially movable within said housing, said pivot pin having a keyed end portion;

means on said pivot pin and said housing to prevent rotation of said pin relative to said housing; and said keyed end portion closely receivable into said first key recess portion or said second key recess portion upon pivoting of said housing relative to said mounting bracket.

12. A kitchen appliance comprising:

a mounting bracket having at least two mounting members extending therefrom, at least one of said mounting members defining at least one keyed opening;

a can opener housing mounted between said mounting members for pivotal movement between a lowered position and a raised position;

a pivot pin axially movable within said housing, said pivot pin defining a keyed end portion and a pin extension portion extending from said end portion;

means on said pivot pin and said housing to prevent rotation of said pin relative to said housing;

a biasing member secured within said housing to bias said keyed end portion of said pin toward at least one of said mounting members, said keyed end portion extending into said keyed opening of said at least one of said mounting members, said keyed opening adapted to closely receive said keyed end portion and prevent rotation of the keyed end portion within said opening and to loosely receive said pin extension portion; and a presser cap mounted adjacent said at least one of said mounting members, said cap defining a projecting member adapted to depress said pin extension portion toward said housing upon depression of said cap.

13. The appliance of claim 12 wherein said biasing member further comprises a spring.

14. The appliance of claim 13 wherein said pivot pin extends along an axis and said housing is pivotable about said axis.

15. The appliance of claim 14 wherein said projecting member extends inwardly substantially along said axis, and the depression of said cap biases said projecting member substantially along said axis.

16. The appliance of claim 15 wherein the depression of said cap and the depression of said pin extension portion causes said keyed end portion to be removed from said keyed opening.

17. The appliance of claim 16 wherein said pin extension portion extends through said keyed opening.

18. The appliance of claim 16 wherein said means on said pivot pin includes a cross-shaped cross-section of said pivot pin for engagement with a cross-shaped opening in said housing.

19. The appliance of claim 16 wherein said means on said pivot pin includes a flange on said pin engageable with said housing.

20. A kitchen appliance comprising:

a mounting bracket having at least two mounting members extending therefrom, at least one of said mounting members defining at least one key recess about a first axis extending through said mounting members;

a housing mounted between said mounting members for pivotal movement about said first axis, an upper interior portion of said housing defining a first ridge and a second ridge;

at least one pivot pin extending through one of said mounting members along said first axis and through said first ridge and said second ridge, said pivot pin axially movable within said housing and defining a flange and a keyed end portion, said keyed end portion receivable into said key recess;

means on said pivot pin and said housing to prevent rotation of said pin relative to said housing; and a coil spring compressible between said flange and said second ridge of said housing, said spring biasing said flange against said first ridge to bias said keyed end portion to extend through a recess in said second ridge.

21. The appliance of claim 20 wherein said housing includes an electric can opener.

* * * * *